US006196701B1

(12) United States Patent
Chang

(10) Patent No.: US 6,196,701 B1
(45) Date of Patent: Mar. 6, 2001

(54) CHAIN SHAPED LAMP

(76) Inventor: Chih-Chen Chang, No. 32, Kuang Hua South Street, Hsinchu City (TW)

( * ) Notice: Subject to any disclaimer, the term of this patent is extended or adjusted under 35 U.S.C. 154(b) by 0 days.

(21) Appl. No.: 09/350,308

(22) Filed: Jul. 9, 1999

(51) Int. Cl.[7] ..... F21W 121/04
(52) U.S. Cl. ..... 362/252; 362/249; 362/806
(58) Field of Search ..... 362/249, 252, 362/240, 104, 367, 806

(56) References Cited

U.S. PATENT DOCUMENTS 2,935,599 * 5/1960 Price, Jr. ..... 362/249 X
4,956,757 * 9/1990 Wang ..... 362/252
4,969,071 * 11/1990 Van Elk ..... 362/249
5,245,519 * 9/1993 Openiano ..... 362/252
5,422,801 * 6/1995 Sangalli et al. ..... 362/252
6,070,991 * 6/2000 Rumpel ..... 362/252 X

* cited by examiner

*Primary Examiner*—Laura K. Tso
(74) *Attorney, Agent, or Firm*—Rosenberg, Klein & Lee

(57) ABSTRACT

The present invention relates to a chain shape lamp, comprising of several chain rings stringing together. Wherein the chain ring is a detachable hollow tube, thereby locate bulbs and wire the cord at inside. The chain shape lamp provided by the present invention has a simple structure, easy assembling, and convenience for locating the bulbs and wiring the cord features, and meeting the necessary of large-scale production.

12 Claims, 7 Drawing Sheets

CHAIN SHAPED LAMP

BACKGROUND OF THE INVENTION

1. Field of the Invention

The present invention relates to a chain shape lamp.

2. Description of Prior Art

So far, along with the development of the society, and the improvement of the people life level, lamp has been used widely. Due the different purposes and ways in using, the lamps are made in variety structures and styles. But due to the complicating structure being difficult in manufacturing and difficulties of locating the bulbs and wiring the cord in combination, a chain shape lamp has not came out in the market yet.

OBJECTS AND SUMMARY OF THE INVENTION

It is therefore a main object of the present invention to provide a chain shape lamp that has a simple structure for manufacturing, and easy locating the bulbs and wiring the cord in assembling.

For archiving the objects, the present invention provides a chain shape lamp, which consists of several chain rings stringed together, the said chain rings hold bulbs and power cord at inside, and two or more detachable connection portions built upon the circumference of the chain ring, the said chain ring also divided into two or more detachable individual chain ring units; and said chain ring unit is a hollow tube composed by two detachable shells, or one of the said chain ring units is only an indivisible hollow tube.

Said chain ring unit has a connection frame on the both ends connecting with another corresponding chain ring unit.

Said shells composing to said chain ring units have bayonet-coupling frames on each separately.

There are proper number of blocks and retainers built upon the inside of the chain ring unit, thereby locating the bulbs and wiring the cord.

For facilitating to wire the cord in or out, there is proper number of through-holes formed on the chain ring unit.

On the places of the chain ring unit around opposite the bulbs, a number of cooling holes and loopholes are drilled.

A fixed hook and a loop are attached on said chain ring unit designed for mounting, extending and making up.

For increasing the effect of spotlighting and decorating, the outside surface of the chain ring unit is even attached with amount of small crowning grains.

Some through-holes are pre-set on the outside surface of the chain ring unit for inserting transmission ornaments, thereby increasing decoration effect.

Due to adopting above-mentioned structures, the present invention can string up a desired number of chain rings together. The feature of the present invention is to provide a simple structure and easy process of assembling, and convenience for locating the bulbs and wiring the cord, and meeting the necessary of large-scale production.

DETAILED DESCRIPTION OF PREFERRED EMBODIMENTS

Referring to FIG. 1 to FIG. 4, the present invention comprises several chain rings 1 stringed up together, therein bulbs 2 and cords 3 are pre-located in the chain rings 1.

Figure 1:
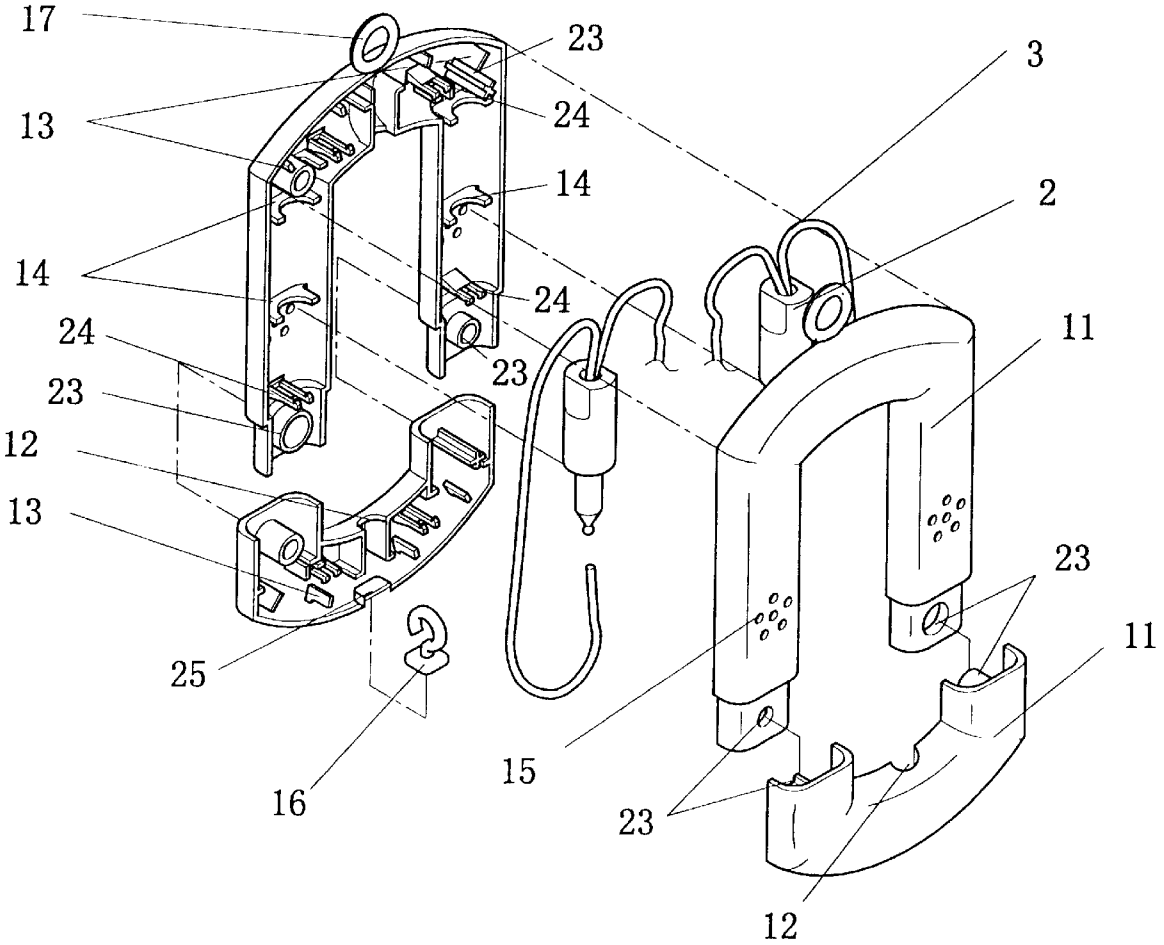
FIG. 1 is an exploded solid view of the present invention.
Figure 2:
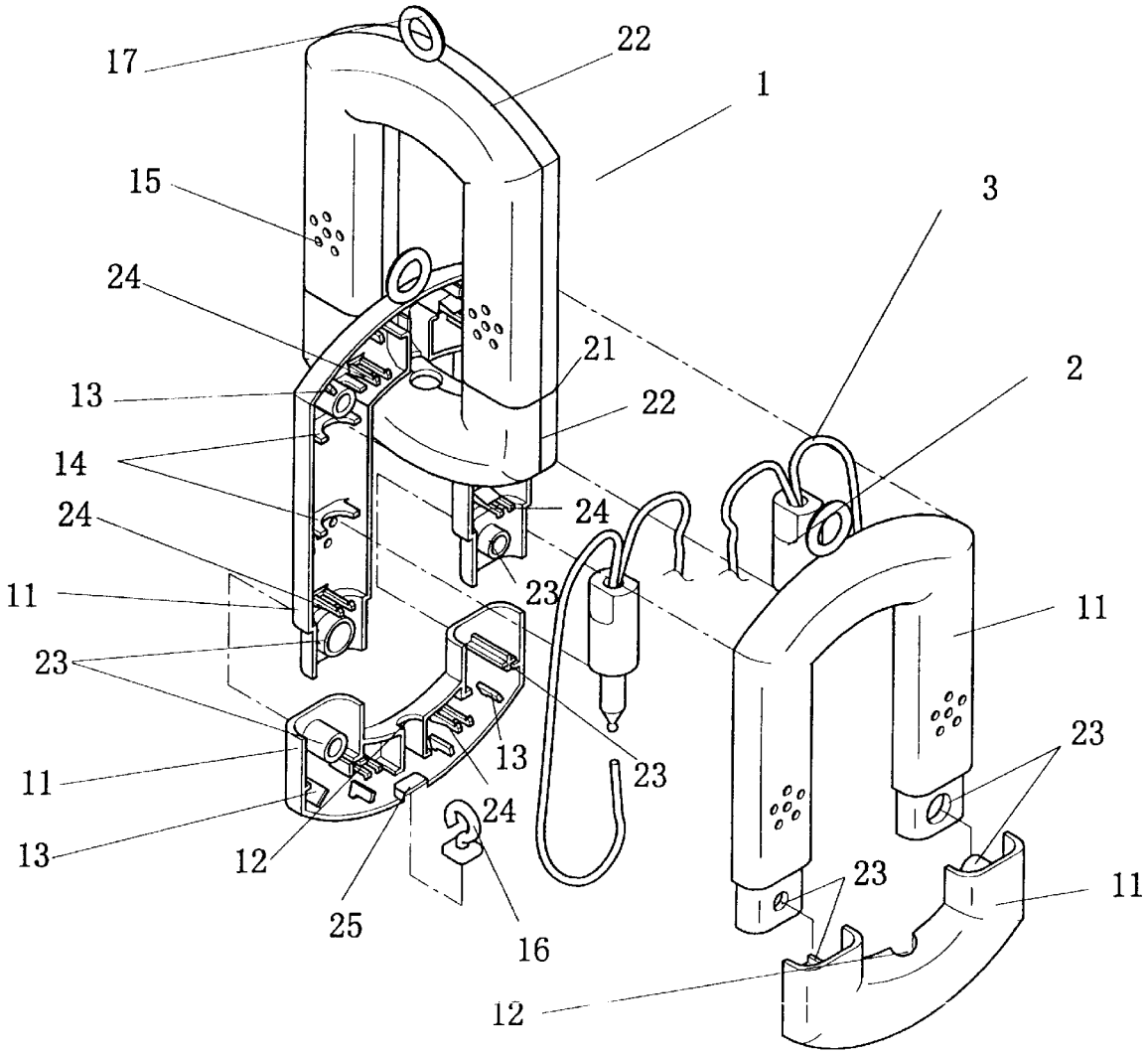
FIG. 2 is an exploded solid view shown the process one of combination of the present invention.
Figure 3:
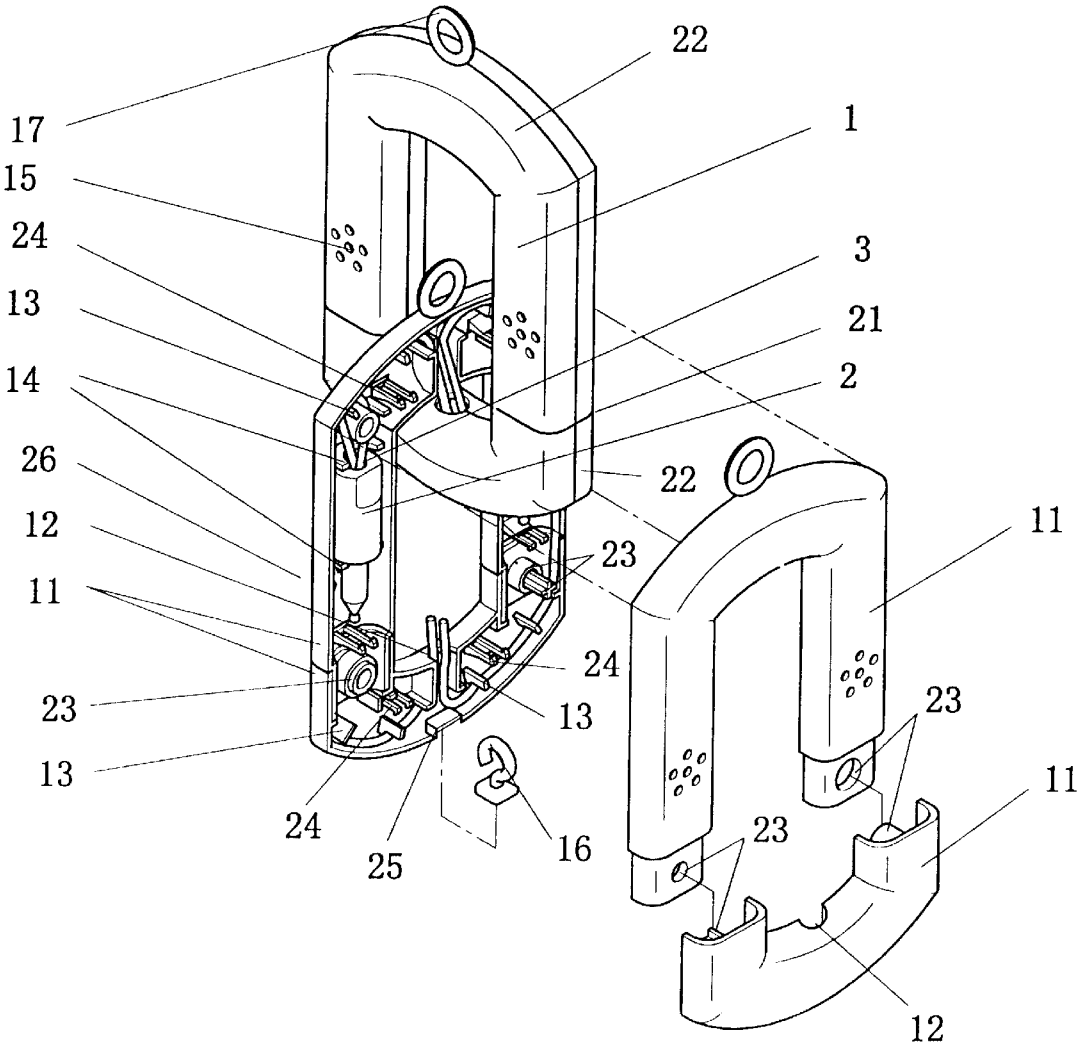
FIG. 3 is an exploded solid view shown the process two of combination of the present invention.
Figure 4:
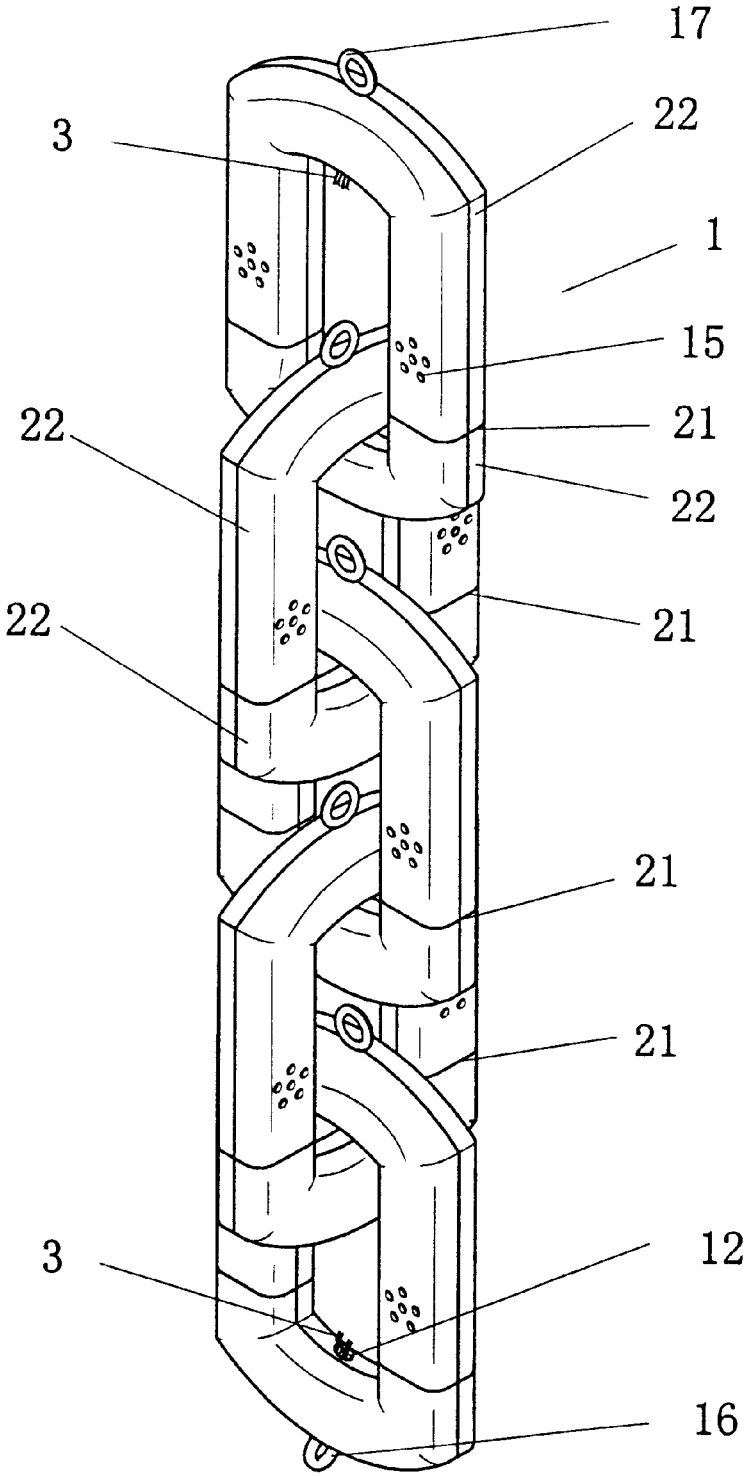
FIG. 4 is a solid view of the present invention.

Wherein, two detachable connection portions 21 built upon the circumference of the chain ring 1, the said chain ring 1 divided into two detachable individual chain ring units 22 (referring to FIG. 2 to FIG. 4). Said chain ring unit 22 has a connection frame 23 formed at both ends for connecting with another chain ring unit 22, and composed by two detachable shells 11 in table joint. Said shell 11 has proper number of through-holes 12 for wiring the cord 3 passing in or out, and several bayonet-coupling frames 24 built upon the proper positions at inside for joining with other shells 11, and some cooling loopholes 15 and retainers 14 built on opposite the bulbs 2, and several blocks 13 formed along the rim keeping in a certain distance each other.

For mounting, extending and making up, a loop 17 is formed on the shell 11, or a retaining slot 25 is pre-built on the shell 11 for holding a fixing hook 16 in.

In combination, first assemble a chain ring 1 and locating the bulbs 2 and wiring the cord 3 at inside in advance. Then saddle a shell 11 of a chain ring unit 22 over a side of the assembled first chain ring 1, and by means of the connection frames 23 assembling with the shell 11 of other chain ring unit 22, a semi-tubular housing 26 is combined, first via the pre-set through-holes 12 and the blocks 13 and retainers 14 the bulbs 2 are located on and the cord 3 is wired at the inside of the semi-tubular housing 26. Then by means of the bayonet-couplings 24, the other shells 11 co-ordination to the semi-tubular housing 26 are spliced together to finish a integrated chain ring 1 stringing up the first chain ring 1.

Depending on mounting and dressing design, the present invention provides other choices, as showing on FIG. 3, therein the shell 11 of the chain ring unit 22 has a loop 17 on the top, and has a retaining slot 25 at the bottom. Referring to FIG. 4, in a string of chain rings 1, the last chain ring 2 is fixed a hook 16 in the retaining slot 25. When extending the string temporally, the next chain ring can hang on the hook 16 with the loop 17.

Figure 5:
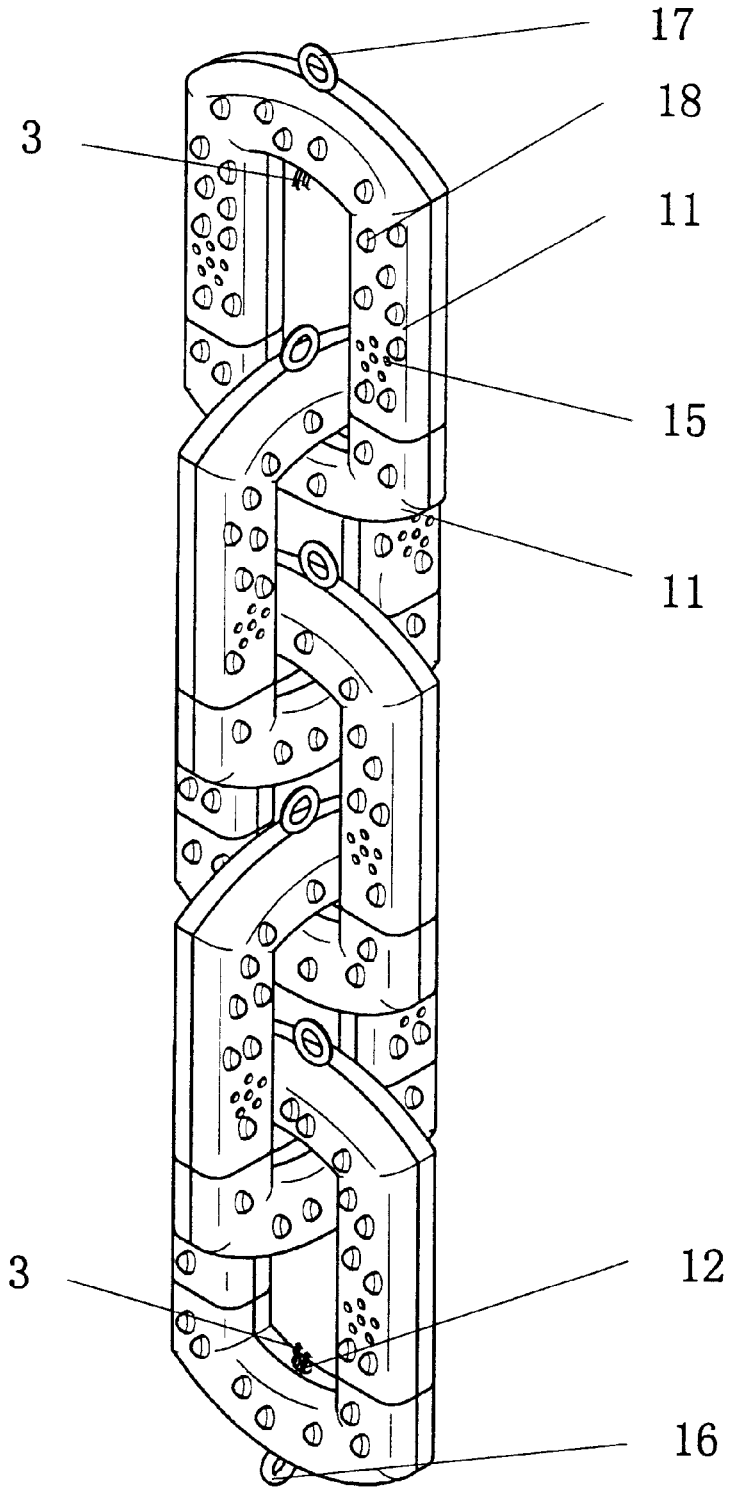
FIG. 5 is a solid view shown the second style of combination of the present invention.

Referring to FIG. 5, the outside surface of the chain ring 1 can be even attached with amount of small crowning grains 18.

Figure 6:
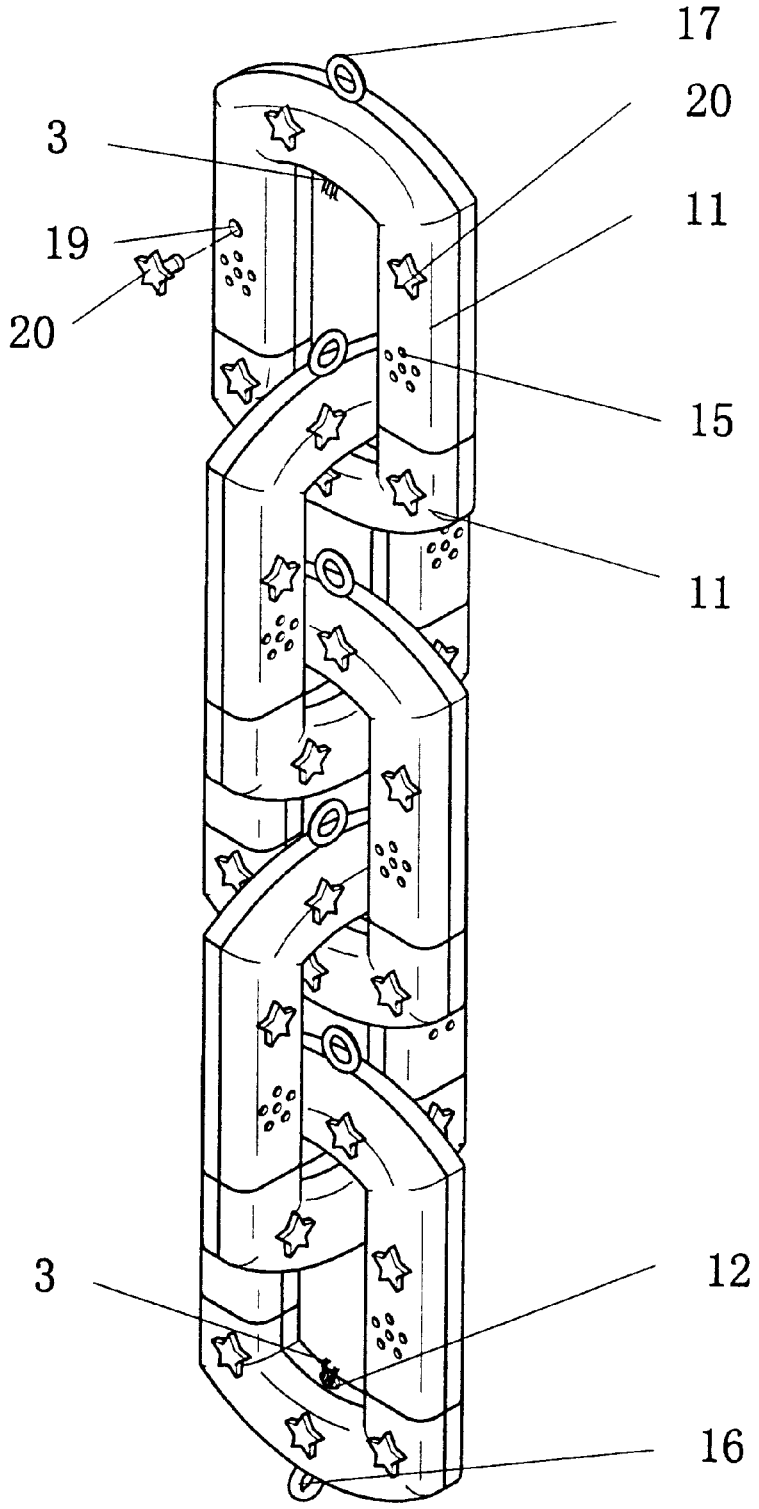
FIG. 6 is a solid view shown the third style of the combination of the present invention.

Referring to FIG. 6, some through-holes 19 are pre-set on the outside surface of he chain ring 1 for inserting transmission ornaments 20, thereby increasing decoration effect.

Figure 7:
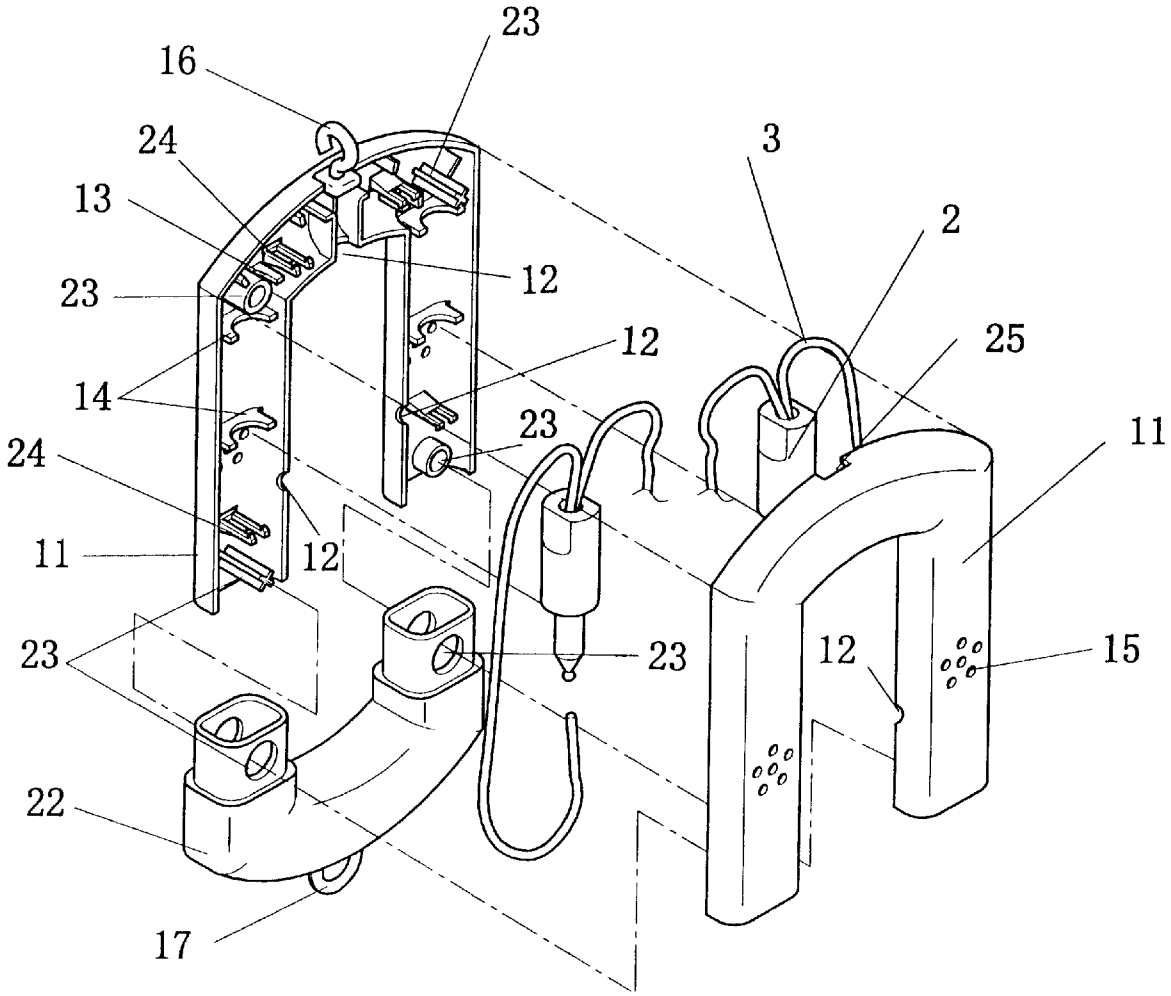
FIG. 7 is an exploded solid view shown the another operation of the present invention.

Referring to FIG. 7, showing another operation of the present invention, the difference with the first operation of the present invention is one of the chain ring units 22 has an indivisible hollow tube without bulbs 2 and cord 22 putting in inside. On both ends of said chain ring unit 22, there are two connection frames 23 formed separately for joining with another chain ring unit 22. Said another chain ring unit 22 has connection frames 23 at connection ends.

In combination, first locate the bulbs 2 and cord 3 in the shells 11 of the detachable chain ring unit 22 as foregoing described, then close the both shells 11 from the both sides, meanwhile by means of the connection frames 23 inserting through the connection frames 23 of said indivisible hollow tube chain ring unit 22, a integrated chain ring 1 is assembled. In the same way as last operation, a string of chain shape lamp is composed.

What is claimed is:

1. A chain shaped lamp apparatus comprising a plurality of interconnected chain rings each having a generally tubular configuration for housing at least one bulb and a portion of a cord extending therefrom, each said chain ring including first and second chain ring units detachably coupled one to the other at a plurality of connection portions, at least one of said first and second chain ring units is defined by a pair of detachably coupled shells.

2. The chain shaped lamp apparatus as recited in claim 1 wherein at least one of said first and second chain ring units is formed integrally.

3. The chain shaped lamp apparatus as recited in claim 1 wherein said first and second chain ring units are formed with respective connection frame portions, each said first chain ring unit connection frame portion engaging one said second chain ring unit connection frame portion to define one said connection portion.

4. The chain shaped lamp apparatus as recited in claim 3 wherein said detachably coupled shells have formed respectively thereon mutually engaging bayonet-coupling frame portions.

5. The chain shaped lamp apparatus as recited in claim 1 wherein each said shell has formed therein at least one protruding block and at least one retainer.

6. The chain shaped lamp apparatus as recited in claim 1 wherein each said first and second chain ring unit has formed therein at least one through hole.

7. The chain shaped lamp apparatus as recited in claim 1 wherein each said shell has formed therethrough a plurality of cooling holes.

8. The chain shaped lamp apparatus as recited in claim 1 further comprising a hook coupled to at least one said shell.

9. The chain shaped lamp apparatus as recited in claim 1 further comprising a loop coupled to at least one said shell.

10. The chain shaped lamp apparatus as recited in claim 1 further comprising a plurality of crowning grains externally formed on at least one said first and second chain ring unit.

11. The chain shaped lamp apparatus as recited in claim 1 wherein each said first and second chain ring unit has formed therethrough a plurality of preset through holes.

12. The chain shaped lamp apparatus as recited in claim 11 further comprising a plurality of transmission ornaments each releasably engaging one said preset through hole.

* * * * *